US006758705B1

(12) United States Patent
Bechtel et al.

(10) Patent No.: US 6,758,705 B1
(45) Date of Patent: Jul. 6, 2004

(54) FOOT PEDAL KIT FOR TROLLING MOTOR

(76) Inventors: Keith D. Bechtel, 28149 State Hwy. 77, Guy Mills, PA (US) 16327; John W. Sampsell, 129 Parker Ave., Franklin, PA (US) 16323

( * ) Notice: Subject to any disclaimer, the term of this patent is extended or adjusted under 35 U.S.C. 154(b) by 0 days.

(21) Appl. No.: 10/401,652

(22) Filed: Mar. 28, 2003

(51) Int. Cl.[7] ..... B63H 20/12
(52) U.S. Cl. ..... 440/7; 114/153
(58) Field of Search ..... 440/7; 114/153

(56) References Cited

U.S. PATENT DOCUMENTS

| | | | | |
|---|---|---|---|---|
| 231,017 A | * | 8/1880 | Davis | 114/363 |
| 2,910,708 A | * | 11/1959 | Albright | 441/65 |
| 2,968,273 A | | 1/1961 | Corbett et al. | 114/153 |
| 3,587,512 A | * | 6/1971 | Patterson | 440/54 |
| 3,602,181 A | | 8/1971 | Harris | 114/153 |
| 4,022,145 A | * | 5/1977 | Tindal | 114/153 |
| 4,037,556 A | | 7/1977 | Harris et al. | 115/18 R |
| 4,515,567 A | | 5/1985 | Wilson | 440/7 |
| 4,728,307 A | | 3/1988 | Burgess | 440/7 |
| 4,827,860 A | | 5/1989 | Buringa | 114/153 |
| 5,152,703 A | | 10/1992 | Clement | 440/7 |
| 5,171,173 A | | 12/1992 | Henderson et al. | 440/7 |
| 5,355,821 A | | 10/1994 | Johnson | 114/144 R |
| 5,465,633 A | | 11/1995 | Bernloehr | 74/512 |
| 5,618,212 A | | 4/1997 | Moore | 440/7 |
| D408,827 S | | 4/1999 | Cook, III et al. | D15/4 |
| 5,954,551 A | | 9/1999 | King | 440/6 |
| 6,126,497 A | | 10/2000 | Stockton | 440/7 |
| 6,223,623 B1 | | 5/2001 | Vance | 74/513 |
| 6,325,684 B1 | | 12/2001 | Knight | 440/6 |
| 6,468,117 B1 | | 10/2002 | Healey | 440/7 |

* cited by examiner

*Primary Examiner*—Sherman Basinger
(74) *Attorney, Agent, or Firm*—Richard K. Thomson

(57) ABSTRACT

A kit is provided permitting a retrofit conversion of an existing trolling motor to foot pedal operation. The kit includes a foot pedal assembly, linking mechanical and electrical cables, and attachment hardware including brackets for attaching the mechanical cable to the trolling motor shaft

7 Claims, 4 Drawing Sheets

FOOT PEDAL KIT FOR TROLLING MOTOR

BACKGROUND AND SUMMARY OF THE INVENTION

The present invention is directed to trolling motors. More particularly, the present invention is directed to a kit to permit a fishing boat's trolling motor to be retrofit for operation by a foot pedal freeing up the fisherman's hands for the more exciting activity of fishing.

The freedom from having to use one hand to control trolling motor speed and direction is attractive to every serious fisherman. Many attempts have been made to provide this freedom. Most of these attempts involve expensive options requiring purchase of an entire boat and motor equipped with the steering feature or an expensive reconstruction of an existing boat and motor.

The present invention provides a kit that can enable any boat equipped with a trolling motor to be retrofit with a foot pedal to provide hands-free operation of the boat. While the kit is specifically designed for a rear-mounted motor for a forward-facing fisherman (and has particular advantages for such a layout), it is possible the kit could be used in boats with other floor plans with loss of some of the features/advantages of the present invention, but retaining most of the advantages over the available systems.

The kit comprises a lever arm connected to a trolling motor shaft; a foot pedal assembly with a foot pedal mounted thereon for pivotal movement about a vertical axis; a foot-engagable switch on a surface portion of said foot pedal; a mechanical cable; first linkage means connecting said mechanical cable to a lateral portion of said foot pedal; second linkage means connecting said mechanical cable to a front face of said lever arm; whereby rotation of said foot pedal about said axis causes axial movement of said mechanical cable which, in turn, produces movement of said lever arm and corresponding rotational movement of said trolling motor shaft. For one preferred configuration, the rotation of the fisherman's foot in a particular direction results in a 1-to-1 angular turning of the boat in that same direction, for the rear-mounted, front-facing layout discussed above.

The mechanical linkage is uncomplicated: no meshing gears that could jam or become worn, no electronics to breakdown. Just a simple, reliable mechanical cable which pushes/pulls the motor to steer the boat.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 1:
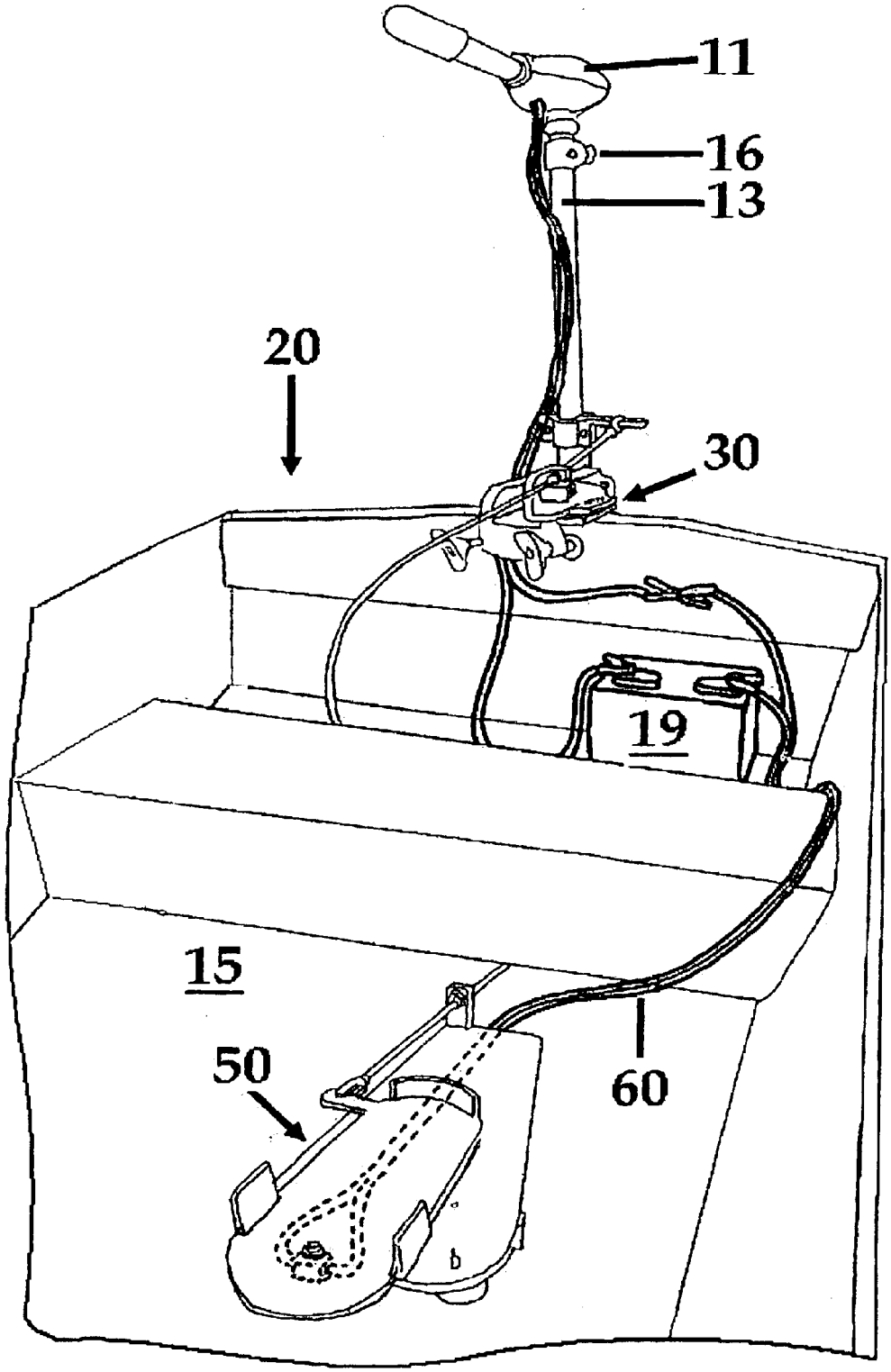
FIG. 1 is a perspective view of a first embodiment of the foot-pedal kit of the present invention in its installed position.
Figure 2:
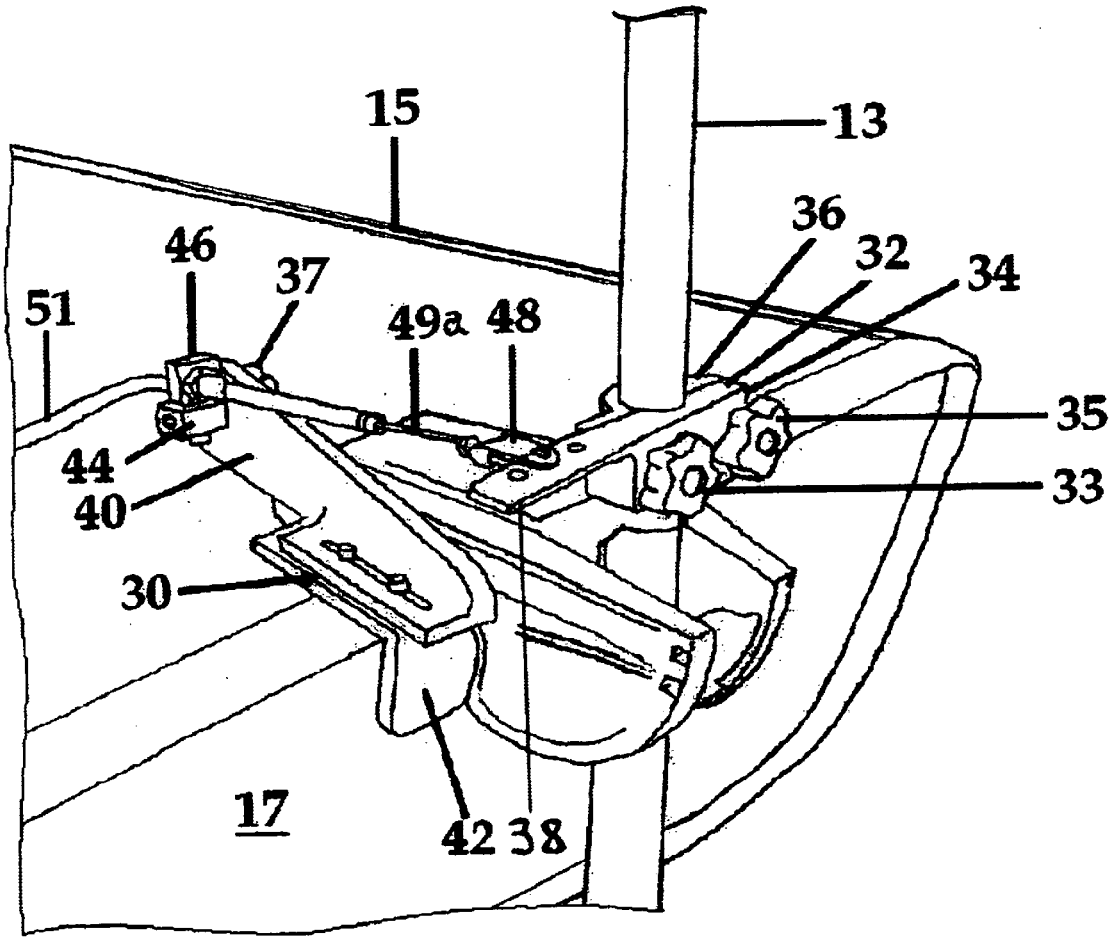
FIG. 2 is a detailed perspective view of the components of the first embodiment of the kit directly attached between the transom and the motor.

A first embodiment of the foot pedal conversion kit for a trolling motor is shown in its deployed position in FIG. 1 generally at 20. Kit 20 comprises a first set of motor-related components 30 and a second set of foot pedal assembly components 50. As best seen in FIG. 2, the motor-related components 30 include a split bracket 32 with a generally straight outside portion 34 and a generally C-shaped inside portion 36. Knobs 33, 35 are used to clamp shaft 13 of trolling motor 11 between outside bracket portion 34 and inside bracket portion 36. A lever arm 38 extends laterally outward from split bracket 32 and serves as means to control the rotational position of trolling motor 11 and, therefore, the direction the fishing boat 15 travels. Adjustable arm 40 is attached to transom 17 of boat 15 by transom mount 42. Adjustable arm 40 can be adjusted both laterally and longitudinally to accommodate variations in trolling motor mounts.

Figure 4:
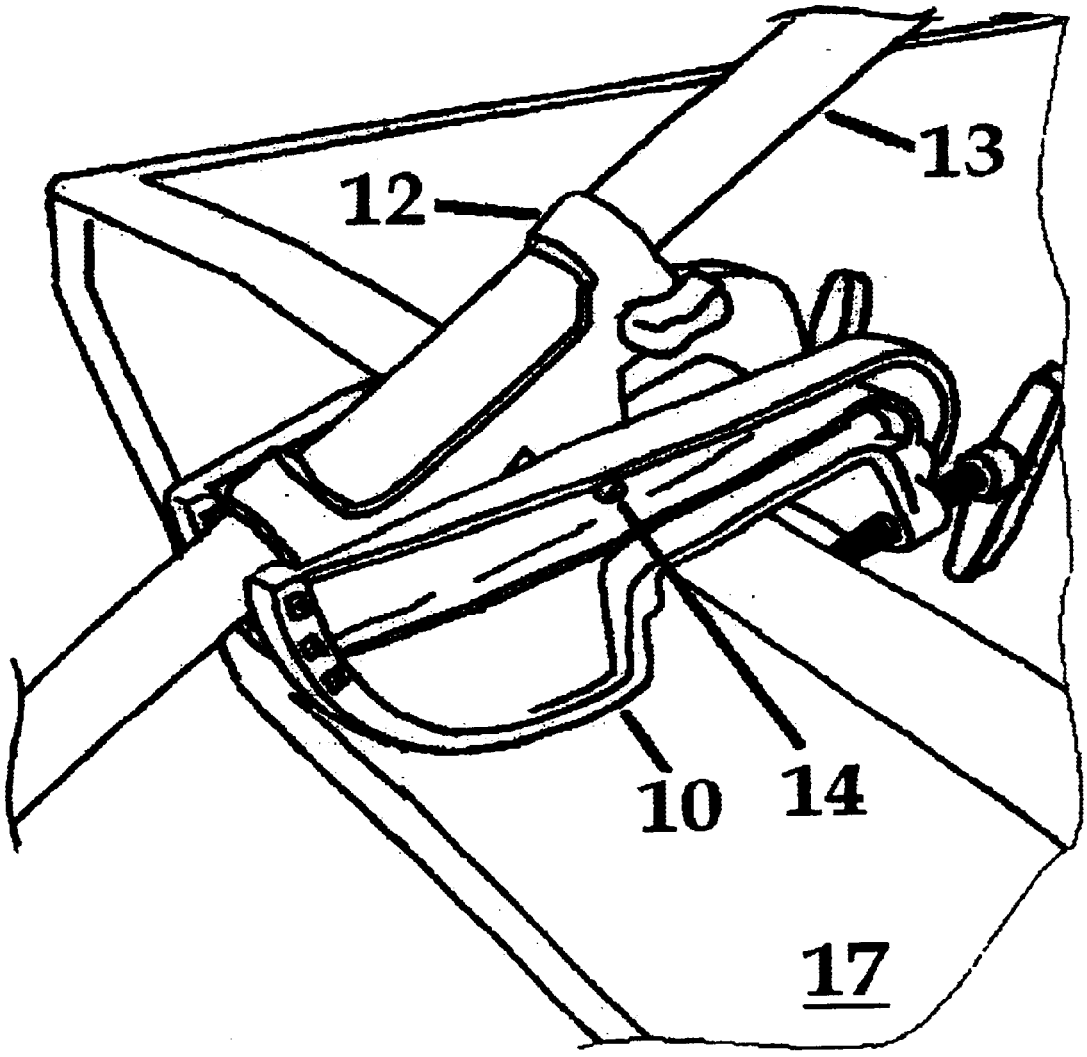
FIG. 4 is a enlarged rear view showing the motor mount.

While it forms no part of the present invention, a typical mount 10 is shown in FIG. 4 to enhance understanding of the operation of the foot pedal kit 20 of the present invention. Motor mount 10 clamps atop transom 17. Motor mount 10 has a bracket 12 which supports shaft 13 of trolling motor 11 for axial rotation. Bracket 12 pivots about pin 14 permitting forward tilting of motor 11 to allow the prop (not shown) to be elevated for trailering or out-of-water stowing. A stop bushing 16 (FIG. 1) is slipped up shaft 13 and its function replaced by bracket 32.

Adjustable support block 44 is locked in an optimum position by tightening knob 37. A swivel block 46 is mounted on support block 44 to rotate about a generally vertical axis (off set from vertical by the amount the top of swivel block 46 is rotated from horizontal). Optimum positioning of support block 44 affords a gentle upward traverse for cable end 49*a* from the swivel block 46 to the clevis 48. Swivel block 46 engages sheath 51 preventing relative axial movement between swivel block 46 and sheath 51. Adjustable arm 40 is moved to provide a particular length, say, for example, 2" of mechanical cable end 49*a* extending out of sheath 51 to clevis 48 when the foot pedal assembly 50 is positioned to steer the boat 15 straight. Clevis 48 connects mechanical cable end 49*a* to lever arm 48. Several securement locations are provided along lever arm 48 to permit the feel of the steering mechanism to be varied. For most applications, the clevis 48 will be attached to the center location on the lever arm 38. This will provide 1-to-1 correspondence between the swivel angle of the foot pedal and the trolling motor 11. For some boats, however, the fisherman may prefer the boat to react more quickly, i.e., have a greater turn so s/he may move the connector point to the inner position on the lever arm 48, or a lesser turn than 1-to-1 (connect to the outer position on lever arm 48).

Figure 3:
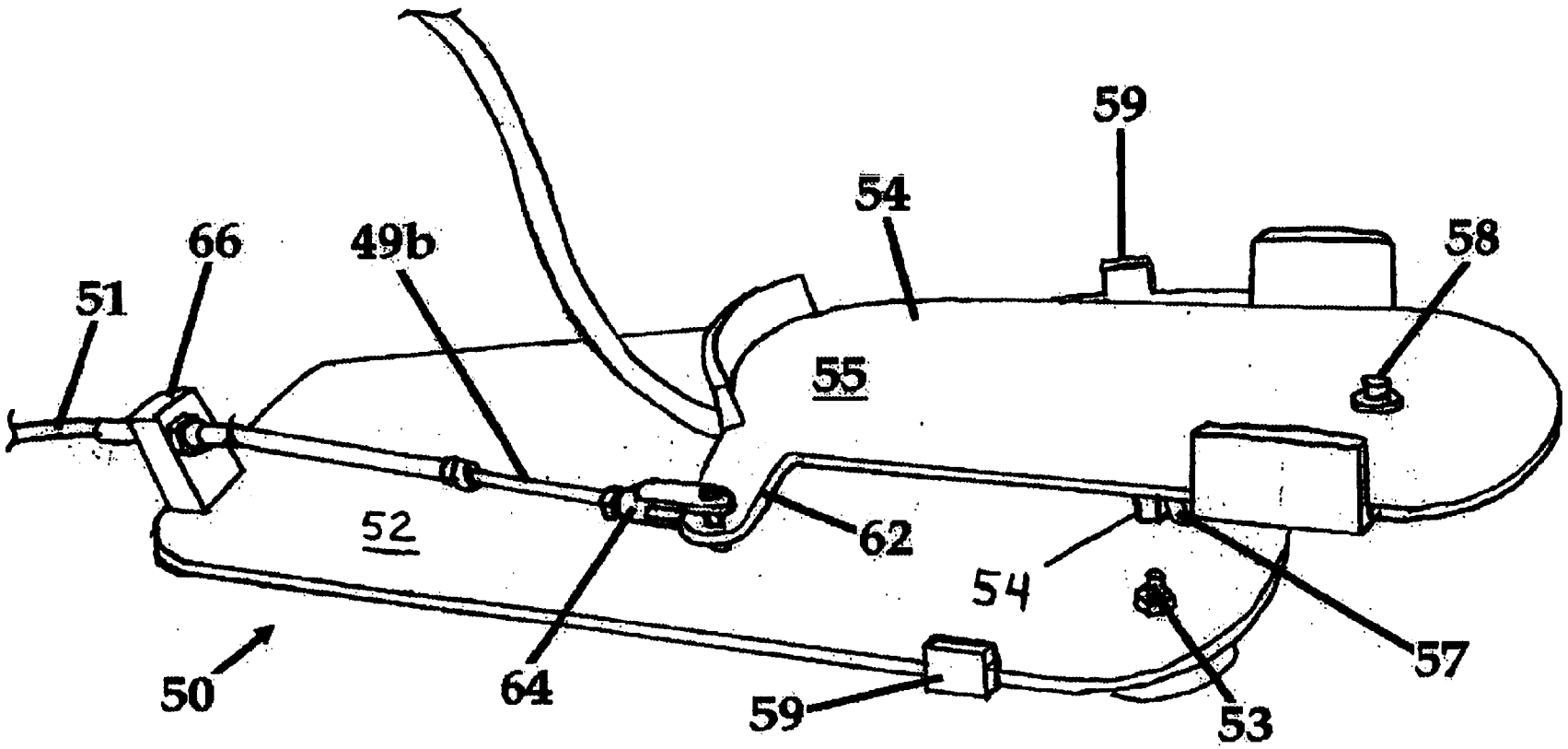
FIG. 3 is a detailed perspective view of the first embodiment of the foot pedal components.

Foot pedal assembly components 50 are best seen in FIG. 3. A base plate 52 is attached to the floor. This may be through bolting as shown at 53 or using suction cups or some other means. A generally foot-shaped foot pedal 54 is pivotally mounted to base plate 52 at 56. The pivot point is at the center of curvature for heal portion 55 of foot pedal 54. A pair of rollers (one shown) 57 support the weight of the forward end of foot pedal 54 and the operator's foot as the pedal is pivoted left and right. Stop blocks 59 along each edge of the base plate 52 prevent overturning of foot pedal 54. An on-off switch 58 is connected to motor 11 and the boat's battery 19 (FIG. 1) by electrical cable 60. Foot pedal 54 has a projection 62 protruding from a first lateral side thereof. Clevis 64 connects mechanical cable end 49*b* to projection 62. A swivel block 66 secures the sheath 51 of mechanical cable end 49*b* against longitudinal movement. Swivel block 66 rotates about a generally vertical axis to permit lateral cable motion to accommodate the relative change of lateral position resulting from the lateral movement of projection 62.

Rotation of the pedal 54 5° results in, say by way of example, an axial translation of mechanical cable end 49*b* of 1'. At the opposite end, mechanical cable end 49*a* is also experiencing a translation of 1" which produces a rotation of trolling motor shaft 13 of 5°. Swivel blocks 46 and 66 rotate to facilitate the swaying of mechanical cable ends 49*a* and 49*b*, respectively, to prevent binding.

Once the foot pedal kit 20 of the present invention has been installed, the fisherman can depress switch 58 with her/his foot activating the trolling motor 11. Rotation of the pedal 54 by the fisherman's foot a particular angularity left or right, will result in a turning of the boat 19 through a related angle in the same direction. For example, with clevis 48 connected to the central position on lever arm 38, when the pedal 54 turns 5° to the left, a 5° turn to port will result and a 5° turn of the pedal to the right will result in a 5° turn to starboard. Positioning clevis 48 at the inboard or outboard positions will result in greater or lesser degrees of turning, respectively.

The foot-pedal kit 20 of the present invention will permit any fisherman to retrofit his trolling motor to allow foot operation freeing up both hands for reeling, casting and landing the big one. This can be done with considerably less trouble and expense than with other available systems.

Various changes, alternatives and modifications will become apparent to one of ordinary skill in the art following a reading of the foregoing specification. It is intended that any such changes, alternatives and modifications as fall within the scope of the appended claims be considered part of the present invention.

We claim:

1. A kit for modifying a trolling motor of a fishing boat to enable foot control thereof, the kit comprising a. a lever arm connected to a trolling motor shaft;

b. a foot pedal assembly with a foot pedal mounted thereon for pivotal movement about a vertical axis;

c. a foot-engagable switch on a surface portion of said foot pedal;

d. a mechanical cable;

e. first linkage means connecting said mechanical cable to a front face of said lever arm;

f. second linkage means connecting said mechanical cable to a lateral portion of said foot pedal;

whereby rotation of said foot pedal about said axis causes axial movement of said mechanical cable which, in turn, produces movement of said lever arm and corresponding rotational movement of said trolling motor shaft.

2. The kit of claim 1 wherein said second linkage means comprises a first clevis and said first lateral portion of said foot pedal includes a projection extending outwardly from a rear section thereof.

3. The kit of claim 2 wherein said foot pedal assembly further comprises a stationary base plate positioned beneath and rotatably mounting said foot pedal.

4. The kit of claim 3 further comprising a block mounted on a portion of said stationary base, said block clamping a first portion of an outer jacket of said mechanical cable against axial movement.

5. The kit of claim 2 wherein said first linkage means comprises a second clevis attached to said lever arm, said lever arm protruding laterally from a split collar which is clamped to the shaft of the trolling motor.

6. The kit of claim 5 further comprising a transom mount and an adjustable arm for connecting said mechanical cable to said lever arm.

7. The kit of claim 6 further comprising an adjustable block and swivel block that engage a second portion of said outer jacket on said mechanical cable restraining said outer jacket against axial movement.

* * * * *